US010900105B2

(12) United States Patent
Perlade et al.

(10) Patent No.: US 10,900,105 B2
(45) Date of Patent: Jan. 26, 2021

(54) LOW-DENSITY HOT-OR COLD-ROLLED STEEL, METHOD FOR IMPLEMENTING SAME AND USE THEREOF

(71) Applicant: ARCELORMITTAL, Luxembourg (LU)

(72) Inventors: Astrid Perlade, Le Ban Saint-Martin (FR); Ian Alberto Zuazo Rodriguez, Metz (FR); Xavier Garat, Homecourt (FR)

(73) Assignee: ArcelorMittal, Luxembourg (LU)

( * ) Notice: Subject to any disclaimer, the term of this patent is extended or adjusted under 35 U.S.C. 154(b) by 269 days.

(21) Appl. No.: 14/404,750

(22) PCT Filed: May 27, 2013

(86) PCT No.: PCT/IB2013/001057
§ 371 (c)(1),
(2) Date: Dec. 1, 2014

(87) PCT Pub. No.: WO2013/179115
PCT Pub. Date: Dec. 5, 2013

(65) Prior Publication Data

US 2015/0147221 A1 May 28, 2015

(30) Foreign Application Priority Data

May 31, 2012 (FR) ..... 2012/000220

(51) Int. Cl.
*C22C 38/14* (2006.01)
*C22C 38/02* (2006.01)
(Continued)

(52) U.S. Cl.
CPC ..... *C22C 38/14* (2013.01); *B21B 1/463* (2013.01); *B21B 45/0203* (2013.01);
(Continued)

(58) Field of Classification Search
None
See application file for complete search history.

(56) References Cited

U.S. PATENT DOCUMENTS 6,984,456 B2 1/2006 Okada et al.
7,588,651 B2 9/2009 Engl
(Continued)

FOREIGN PATENT DOCUMENTS

CN 101591751 12/2009
EP 2090668 A1 8/2009
(Continued)

OTHER PUBLICATIONS

Machine-English translation of JP2006-118000, Fujita Nobuhiro et al., May 11, 2006.*

(Continued)

*Primary Examiner* — Colin W. Slifka
(74) *Attorney, Agent, or Firm* — Davidson, Davidson & Kappel, LLC

(57) ABSTRACT

A rolled steel sheet is provided. The rolled steel sheet has a mechanical strength greater than or equal to 600 MPa and an elongation at fracture that is greater than or equal to 20%. A a method for its fabrication is also provided. The chemical composition of the steel sheet includes 0.10≤C≤0.30%, 6.0≤Mn≤15.0%, 6.0≤Al≤15.0%, and optionally one or more elements selected from among: Si≤2.0%, Ti≤0.2%, V≤0.6% and Nb≤0.3%. The remainder of the composition includes iron and the unavoidable impurities resulting from processing. The ratio of the weight of manganese to the weight of aluminum is such that $$\frac{Mn}{Al} > 1.0.$$

(Continued)

The microstructure of the sheet includes ferrite, austenite and up to 5% Kappa precipitates in area fraction.

32 Claims, 4 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***C21D 8/02*** | (2006.01) |
| ***C21D 9/46*** | (2006.01) |
| ***C21D 6/00*** | (2006.01) |
| ***C21D 8/04*** | (2006.01) |
| ***B21B 1/46*** | (2006.01) |
| ***B21B 45/02*** | (2006.01) |
| ***B21C 47/02*** | (2006.01) |

(52) U.S. Cl.

CPC ..... *B21C 47/02* (2013.01); *C21D 6/005* (2013.01); *C21D 8/0205* (2013.01); *C21D 8/0226* (2013.01); *C21D 8/0236* (2013.01); *C21D 8/0436* (2013.01); *C21D 8/0473* (2013.01); *C21D 9/46* (2013.01); *C22C 38/02* (2013.01); *C22C 38/04* (2013.01); *C22C 38/06* (2013.01); *C22C 38/12* (2013.01); *C21D 2211/001* (2013.01); *C21D 2211/004* (2013.01); *C21D 2211/005* (2013.01)

(56) References Cited

U.S. PATENT DOCUMENTS

| | | | |
|---|---|---|---|
| 8,778,097 | B2 | 7/2014 | Chin et al. |
| 9,580,766 | B2 | 2/2017 | Perlade et al. |
| 2006/0231177 | A1 | 10/2006 | Bano |
| 2009/0297387 | A1 | 12/2009 | Chin |

FOREIGN PATENT DOCUMENTS

| | | | |
|---|---|---|---|
| EP | 2128293 | A1 | 12/2009 |
| JP | H03500305 | | 1/1991 |
| JP | H03140439 | | 6/1991 |
| JP | H0987889 | A | 3/1997 |
| JP | 2004098659 | A | 4/2004 |
| JP | 2005015909 | | 1/2005 |
| JP | 2005120390 | A | 5/2005 |
| JP | 2005120399 | A | 5/2005 |
| JP | 2005325388 | A | 11/2005 |
| JP | 2006118000 | A | 5/2006 |
| JP | 2007084882 | | 4/2007 |
| JP | 2009287114 | | 12/2009 |
| JP | 2010526939 | | 8/2010 |
| JP | 2010209377 | | 9/2010 |
| RU | 2329308 | C2 | 7/2008 |
| RU | 2436849 | C2 | 12/2011 |
| SU | 768846 | A | 10/1980 |
| WO | WO9000629 | | 1/1990 |
| WO | 03096776 | A1 | 11/2003 |
| WO | 2007024092 | A1 | 3/2007 |

OTHER PUBLICATIONS

Xu et al.: "High Strength Light Weight Steels Based on FE-MN-AL-C Microstructures *Mechanical Properties," Proceedings of Plasticity, XX, XX, Jan. 31, 2003, pp. 169-171, XP001248072, pp. 171; figures 2, 3.

Han et al.: "Effect of Carbon Content on Cracking Phenomenon Occurring during Cold Rolling of Three Light-Weight Steel Plates," Metallurgical and Materials Transactions A, Springer-Verlag, New York, vol. 42, No. 1, Oct. 19, 2010, pp. 138-146, XP019854785, ISSN: 1543-1940, DOI: 10.1007/S1161-010-0456-3.

Heo et al:Influence of silicon in low density Fe-C-Mn-Al Steel Metallurgical and Materials Transactions A 43 (2012) 1731-1735.

* cited by examiner

LOW-DENSITY HOT-OR COLD-ROLLED STEEL, METHOD FOR IMPLEMENTING SAME AND USE THEREOF

This invention relates to a rolled steel having a mechanical strength greater than or equal to 600 MPa and elongation at fracture greater than or equal to 20% as well as a method for fabrication.

BACKGROUND

Environmental restrictions are forcing automakers to continuously reduce the $CO_2$ emissions of their vehicles. To do that, automakers have several options, whereby their principal options are to reduce the weight of the vehicles or to improve the efficiency of their engine systems. Advances are frequently achieved by a combination of the two approaches. This invention relates to the first option, namely the reduction of the weight of the motor vehicles. In this very specific field, there is a two-track alternative:

The first track consists of reducing the thicknesses of the steels while increasing their levels of mechanical strength. Unfortunately, this solution has its limits on account of a prohibitive decrease in the rigidity of certain automotive parts and the appearance of acoustical problems that create uncomfortable conditions for the passenger, not to mention the unavoidable loss of ductility associated with the increase in mechanical strength.

The second track consists of reducing the density of the steels by alloying them with other, lighter metals. Among these alloys, the low-density ones called iron-aluminum alloys have attractive mechanical and physical properties while making it possible to significantly reduce the weight. In this case, low density means a density less than or equal to 7.3.

The addition of aluminum to the iron, on account of its low density in relation to the latter, has made it possible to expect substantial reductions in weight for automotive structural parts. It is in this regard that patent application EP2128293 describes a hot-rolled or cold-rolled sheet having a composition of 0.2-0.8% C, 2-10% Mn, 3-15% Al and a structure containing less than 99% ferrite and more than 1% residual austenite. The sheet has a mechanical strength in the range of 600-1000 MPa, a density less than 7.2 and is coatable. The method for the fabrication of hot-rolled sheet consists of heating to between 1000 and 1200° C., rolling at a final rolling temperature between 700 and 850° C. and coiling at a temperature less than 600° C. For cold-rolled sheet, the hot-rolled sheet is cold-rolled with a reduction between 40 and 90% and reheated at a rate of between 1 and 20° C./s to a temperature between the recrystallization temperature and 900° C. for 10 to 180 seconds. The object of this patent application is to prevent "roping" and the appearance of rolling cracks by limiting the Mn/Al ratio to a value between 0.4 and 1.0. Above a ratio of 1.0, cold rolling results in the appearance of cracks.

Patent application JP2006118000 describes a lightweight steel that exhibits high strength as well as good ductility. To accomplish that, the composition of the proposed steel contains a percentage by weight of 0.1 to 1.0% C, less than 3.0% Si, 10.0 to 50.0% Mn, less than 0.01% P, less than 0.01% S, 5.0 to 15.0% Al and 0.001 to 0.05% N, the remainder being iron and unavoidable impurities; if equation (1) below is satisfied, the steel will have a density less than or equal to 7.0.

$$C \leq -0.020 \times Mn + Al/15 + 0.53 \quad (1).$$

It will have a microstructure that contains ferrite and austenite. The product of the mechanical strength times total elongation must satisfy the following inequation: TS×El≥20,000 (MPa×%). The rolling characteristics of steels with such high concentrations of alloy elements Mn and Al is known to be subject to major risks of the appearance of cracks.

The object of patent application WO2007/024092 is to make available hot-rolled sheet that can be easily stamped. This application relates to a sheet containing 0.2-1% C, 8-15% Mn, with a product of mechanical strength times elongation of 24,000 MPa %. It appears that this application relates to a totally austenitic structure, although this type of microstructure is particularly difficult to roll.

BRIEF SUMMARY OF THE INVENTION

An object of the present invention is to resolve these problems by making available hot-rolled or cold-rolled steel sheets that simultaneously have:

A density less than or equal to 7.3;

A mechanical strength greater than or equal to 600 MPa;

An elongation at fracture greater than or equal to 20%;

Good suitability for forming, in particular for rolling; and

Good weldability and good coatability.

Another object of the present invention is also to make available a method for the fabrication of these sheets that is compatible with conventional industrial applications while being relatively insensitive to the fabrication conditions.

The present invention provides a rolled steel sheet, the density of which is less than or equal to 7.3 and the composition of which is as follows, expressed in percent by weight:

$$0.10 \leq C \leq 0.30\%$$

$$6.0 \leq Mn \leq 15.0\%$$

$$6.0 \leq Al \leq 15.0\%$$

and optionally one or more elements selected from:

$$Si \leq 2.0\%$$

$$Ti \leq 0.2\%$$

$$V \leq 0.6\%$$

$$Nb \leq 0.3\%$$

the remainder of the composition consisting of iron and the unavoidable impurities resulting from processing, whereby the ratio of the weight of manganese to the weight of aluminum is such that $$\frac{Mn}{Al} > 1.0,$$

and the microstructure of the sheet consists of ferrite, austenite and up to 5% Kappa precipitates in area fraction.

In one preferred embodiment of the invention, the composition includes the following, expressed in percent by weight:

$$0.18 \leq C \leq 0.21\%$$

In another preferred embodiment of the invention, the composition includes the following, expressed in percent by weight:

$$7.0 \leq Mn \leq 10.0\%$$

In another preferred embodiment of the invention, the composition includes the following, expressed in percent by weight:

$$6.0 \leq Al \leq 12.0\%$$

In another preferred embodiment of the invention, the composition includes the following, expressed in percent by weight:

$$6.0 \leq Al \leq 9.0\%$$

In another preferred embodiment of the invention, the composition includes the following, expressed in percent by weight:

$$Si \leq 1\%$$

Preferably, the ratio of the manganese content by weight to the aluminum content by weight is such that:

$$\frac{Mn}{Al} \geq 1.1,$$

and more preferably, the ratio is such that $$\frac{Mn}{Al} \geq 1.5,$$

or even more preferably, the ratio is such that $$\frac{Mn}{Al} \geq 2.0.$$

The sheet claimed by the invention is again preferably such that the mechanical tensile strength is greater than or equal to 600 MPa and the elongation at fracture is greater than or equal to 20%.

The present invention also provides a method for the fabrication of a rolled steel sheet having a density less than or equal to 7.3 that comprises the steps of procuring a steel having a composition as claimed by the invention, casting this steel to form a semi-finished product, —reheating this semi-finished product to a temperature $T_{rech}$ between 1000° C. and 1280° C., hot-rolling this semi-finished product with at least one pass in the presence of ferrite to obtain a sheet, the final rolling pass is carried out at a final rolling temperature $T_{FL}$ which is greater than or equal to 850° C. and cooling this sheet at a cooling rate $V_{ref1}$ to the coiling temperature $T_{bob}$ of less than or equal to 600° C., then, coiling this cooled sheet to $T_{bob}$.

In a preferred embodiment of the present invention, a method for the fabrication of a rolled sheet such that this semi-finished product is cast directly in the form of thin slabs or thin strip is provided.

The final rolling temperature $T_{FL}$ is preferably between 900 and 980° C.

The cooling rate $V_{ref1}$ is preferably less than or equal to 55° C./s.

The coiling temperature is preferably between 450 and 550° C.

The present invention further provides a method for the fabrication of a cold-rolled and annealed steel sheet with a density less than or equal to 7.3 that comprises the steps of procuring a rolled steel sheet, then cold rolling this rolled sheet at a reduction rate between 35 and 90% to obtain a cold-rolled sheet, then heating this sheet at a rate $V_c$ to a hold temperature $T_m$ between 800 and 950° C. for a length of time $t_m$ less than 600 seconds, then cooling this sheet at a rate $V_{ref2}$ to a temperature of less than or equal to 500° C.

The temperature $T_m$ is preferably between 800 and 900° C.

The rate of cooling $V_{ref2}$ is preferably greater than or equal to 30° C./s.

The rate of cooling $V_{ref2}$ is preferably maintained to a temperature between 500° C. and 460° C.

The cooled sheet is preferably coated with zinc, a zinc alloy or a zinc-based alloy.

A steel sheet in accordance with the present invention can be used for the fabrication of structural parts or skin parts for engine-powered land vehicles.

BRIEF DESCRIPTION OF THE DRAWINGS

Other characteristics and advantages of the invention will be described in greater detail below. The accompanying figures are provided by way of non-limiting examples, in which.

DETAILED DESCRIPTION

The present invention relates to hot-rolled or cold-rolled steel sheets that have a reduced density compared to conventional steels and the density of which is less than or equal to 7.3, while preserving the mechanical characteristics of formability, mechanical strength, weldability and satisfactory coatability. This invention further relates to a fabrication method that makes it possible to hot roll or cold roll the steel as claimed by the invention to obtain a hot-rolled or cold-rolled sheet having a microstructure that comprises ferrite, austenite and up to 5% Kappa precipitates in area fraction.

To do that, the chemical composition of the steel is very important both for the mechanical behavior of the sheet and for its processing. The chemical compositions described below are given in percentage by weight.

The invention teaches that the carbon content is between 0.10 and 0.30%. Carbon is a gammagenous element. With manganese, it promotes the appearance of austenite and, with aluminum, the formation of Kappa precipitates based on the stoichiometry $(Fe,Mn)_3AlC_x$, where x is strictly less than one. Below 0.10%, the mechanical strength of 600 MPa is not achieved. If the carbon content is greater than 0.30%, the formation of Kappa precipitates will be excessive, as greater than 5%, and the rolling of the steel sheet will lead to cracks. Preferably, the carbon content will be limited to not more than 0.21% to minimize the risk of the appearance of rolling cracks. Preferably, the minimum carbon content will also be greater than or equal to 0.18% to more easily achieve the mechanical strength of 600 MPa.

The manganese content must be between 6.0% and 15.0%. This element is also gammagenous. The purpose of adding manganese is essentially to obtain a structure that contains austenite in addition to ferrite. It also has a hardening effect in solid solution and a stabilizing effect on the austenite. The ratio of the manganese content to the aluminum content will have a strong influence on the structures obtained after rolling. With a manganese content less than 6.0%, the 20% elongation at fracture is not achieved and the austenite will be insufficiently stabilized with the risk of premature transformation into martensite during a rapid cooling, both at the exit from the hot rolling mill and an annealing line. Above 15.0%, on account of its gammagenous effect, manganese excessively increases the volume fraction of austenite, resulting in a de facto reduction of the carbon concentration of the austenitic phase, which would make it impossible to achieve a strength of 600 MPa. Preferably, the addition of manganese will be limited to 10.0%. For the lower limit, the manganese content will preferably be 7.0% to more easily achieve the elongation of 20%.

Figure 7:
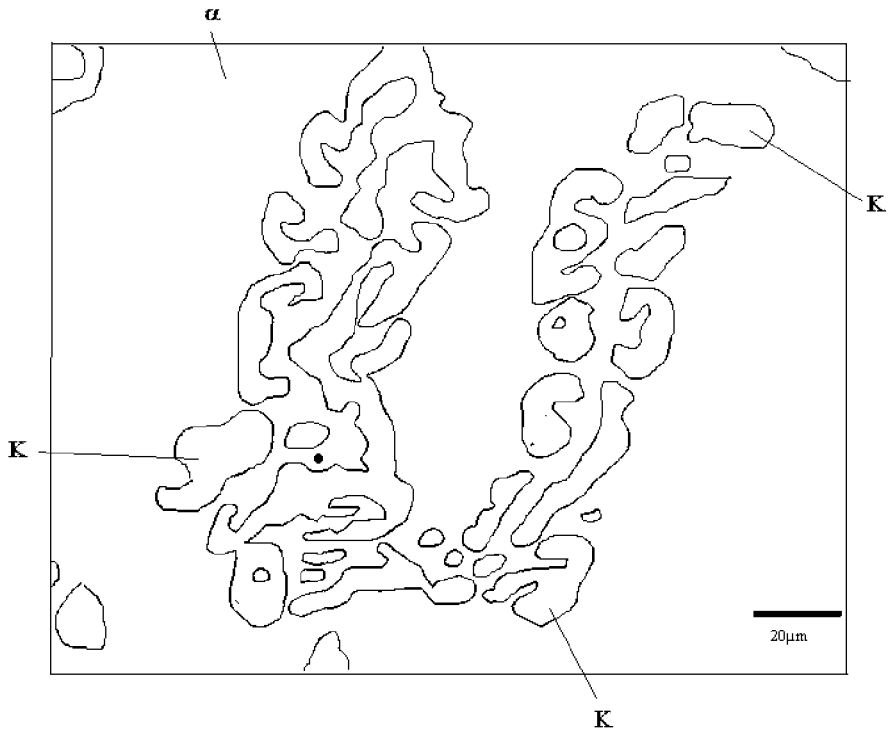
FIG. 7 illustrates the microstructure of cold-rolled sheet that does not satisfy the conditions of the invention.

The aluminum content must also be between 6.0% and 15.0%. Aluminum is an alphagenous element and therefore reduces the austenitic range, and this element tends to promote the formation of Kappa precipitates by combining with carbon. The aluminum has a density of 2.7 and has a strong influence on the mechanical properties. As the aluminum content increases, the mechanical strength and the elastic limit also increase although the elongation at fracture decreases, which is explained by a decrease in the mobility of dislocations. Below 6.0%, the density reduction affected due to the presence of aluminum becomes less beneficial. Above 15.0%, uncontrolled Kappa precipitation with an area density greater than 5% occurs and has an adverse effect on the ductility of the material. Preferably, the aluminum content will be limited to strictly less than 9.0% to prevent brittle intermetallic precipitation. FIG. 7 illustrates a microstructure in which the Kappa precipitates are formed in an uncontrolled manner.

The ratio of the content of manganese by weight to that of the aluminum is essential because it governs the stability of the austenite and the nature of the structures formed during the fabrication cycle. Below a ratio of 1.0 inclusive, the nature of the phases formed depends too greatly on the rate of cooling, both after hot rolling and after recrystallization annealing for the cold-rolled sheets. That creates a risk of the formation of martensite from the austenite, or even the disappearance of the austenite in favor of ferrite and Kappa precipitates as illustrated in FIG. 7. The microstructure of the sheet claimed by the invention eliminates the presence of the martensite and ensures the presence of stable austenite. In addition, it is undesirable to have a ratio $$\frac{Mn}{Al} \leq 1.0$$

to ensure good rollability and a sheet that is insensitive to the manufacturing conditions.

Above a ratio of the content by weight of manganese to that of aluminum equal to 1.0, the sheet produced is relatively insensitive to the fabrication conditions while remaining easily rollable for both hot rolling and cold rolling. This decrease in sensitivity can be improved by increasing the ratio, as a result of which a ratio greater than or equal to 1.1 is preferred, preferably a ratio greater than or equal to 1.5 or even more preferably a ratio greater than or equal to 2.0.

Like aluminum, silicon is an element that makes it possible to reduce the density of the steel and to reduce the stacking defect energy. This reduction makes it possible to obtain a TRIP effect which will be familiar to a person skilled in the art. Nevertheless, its content is limited to 2.0% because above that level this element has a tendency to form strongly adhesive oxides that generate surface defects. The presence of surface oxides leads to wettability defects during a potential hot-dip galvanizing operation, for example. The Si content will preferably be limited to 1%.

Micro-alloy elements such as titanium, vanadium and niobium can be added in respective quantities of less than 0.2%, 0.6% and 0.3% to obtain additional precipitation hardening. Titanium and niobium in particular make it possible to control the grain size during solidification. Nevertheless, some limitation is necessary because above that, a saturation effect is achieved.

Other elements such as cerium, boron, magnesium or zirconium can be added individually or in combination in the following proportions: Ce≤0.1%, B≤0.01, Mg≤0.010 and Zr≤0.010. Up to the maximum content levels indicated, these elements make it possible to refine the ferrite grain during solidification.

The remainder of the composition consists of iron and the unavoidable impurities resulting from processing.

The microstructure of the sheet claimed by the invention consists of ferrite, austenite and up to 5% Kappa precipitates in area fraction. The ferrite has a carbon solubility that increases with the temperature. However, carbon in solid solution is highly embrittling for low-density steels because it further reduces the mobility of dislocations, which is already low on account of the presence of aluminum. Carbon saturation in the ferrite can therefore lead to the activation of a twinning mechanism within the ferrite. Therefore, without being bound by this theory, the inventors are advancing the theory that the austenite and precipitates act as effective carbon traps and facilitate rolling in the intercritical range. This approach is surprising, because it could be thought that the formation of these hard phases must be prevented to facilitate rolling, although the solubility of carbon in austenite and in precipitates is higher than in ferrite. This combination of structure containing ferrite, austenite up to 5% Kappa precipitates as an area fraction therefore gives the sheet the necessary ductility both in terms of its rollability during rolling and during the fabrication of structural parts. It is specified that the rate of recrystallization of the ferrite after annealing or after coiling will be greater than 90% and ideally 100%. If the recrystallized ferrite fraction is less than 90%, the sheet obtained will not exhibit the 20% elongation required by the invention.

Numerous metallographic experiments and studies have enabled the inventors to show that the localized presence of Kappa-type precipitates in spheroids around the ferrite grain boundaries reduces the rollability of the sheet.

The area fraction of the Kappa precipitates can be as high as 5%, because above 5% the ductility decreases and the 20% elongation at fracture of the invention cannot be achieved. In addition, there is also a risk of uncontrolled Kappa precipitation around the ferrite grain boundaries, which would increase the rolling force on the sheet claimed by the invention using conventional industrial-scale steel rolling tools. Therefore, the preferred target range will be less than 2% Kappa precipitates. It is stipulated that because the microstructure is uniform, the area fraction is equal to the volume fraction.

The method for the fabrication of a hot-rolled sheet claimed by the invention is the following:

Procurement of a steel having the composition claimed by the invention.

A semi-finished product is cast from this steel. The casting can be done either into ingots or continuously in the form of thin slabs or thin strip, i.e. with a thickness ranging from approximately 220 mm for the slabs up to several tens of millimeters for the thin strip.

The cast semi-finished products are then reheated to a temperature between 1000° C. and 1280° C. so that there is a temperature at all points that is favorable to the major deformations experienced during rolling. Above 1280° C., there is a risk of the formation of particularly rough ferrite grains, and numerous tests performed by the inventors have found a correlation between the initial ferrite grain size and the capacity of these grains to re-crystallize during hot rolling. The larger the initial ferrite grain size, the less easily it re-crystallizes, which means that reheat temperatures above 1280° C. must be avoided because they are industrially expensive and unfavorable in terms of the recrystallization of the ferrite. They can also amplify the phenomenon called "roping". Roping is due to a collection of small, slightly misoriented grains within larger-size grains. This phenomenon is visible in the form of the preferential location of deformations in bands in the direction of rolling. It is due to the presence of restored, non re-crystallized grains. It is measured by a small elongation distributed in the transverse direction.

Below 1000° C., it becomes increasingly difficult to have a final rolling temperature above 850° C. Preferably, the reheat temperature is between 1150 in 1280° C.

The following steps make it possible to avoid the phenomenon of roping and to achieve good ductility and good stamping qualities:

It is necessary to perform the rolling with at least one rolling pass in the presence of ferrite, i.e. in the partly or totally ferritic range. The purpose is to prevent carbon saturation in the ferrite, which can lead to twinning. The austenite grains also act as effective carbon traps, because the solubility of carbon in austenite is higher than in ferrite.

Figure 3:
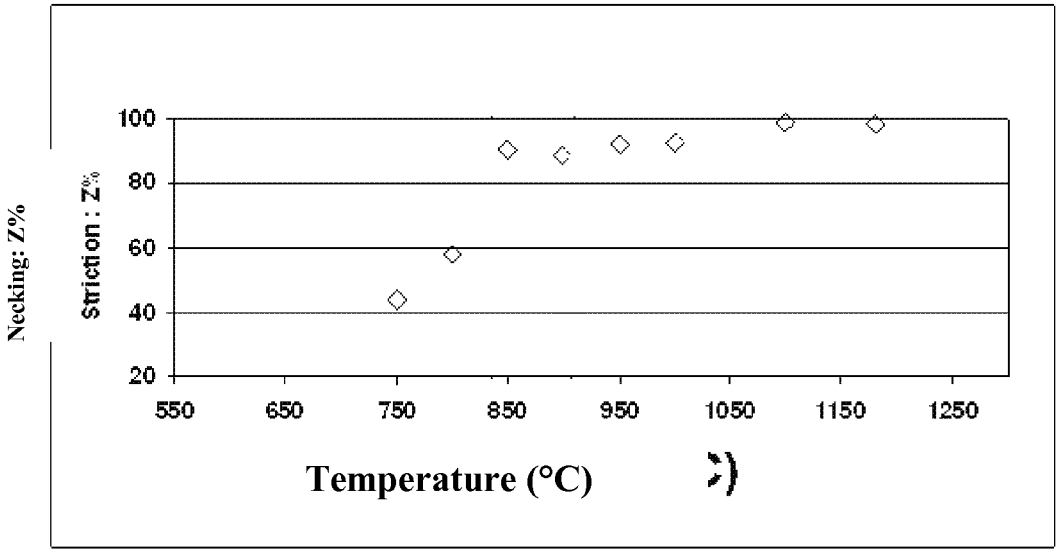
FIG. 3 illustrates the mechanical behavior under traction, hot, representing the hot rolling characteristics as a function of the tensile temperature in ° C.

The final rolling pass is performed at a temperature greater than 850° C., because below this temperature the steel sheet claimed by the invention exhibits a significant drop in rollability as illustrated in FIG. 3, which illustrates the necking of test pieces subjected to traction under hot conditions at different temperatures. A final rolling temperature between 900 and 980° C. is preferred to have a structure that is favorable to recrystallization and rolling.

The sheet obtained in this manner is then cooled at a cooling rate [$V_{ref1}$] to the coiling temperature $T_{bob}$. Preferably, the cooling rate $V_{ref1}$ will be less than or equal to 55° C./s to optimally control the Kappa precipitation.

Figure 2:
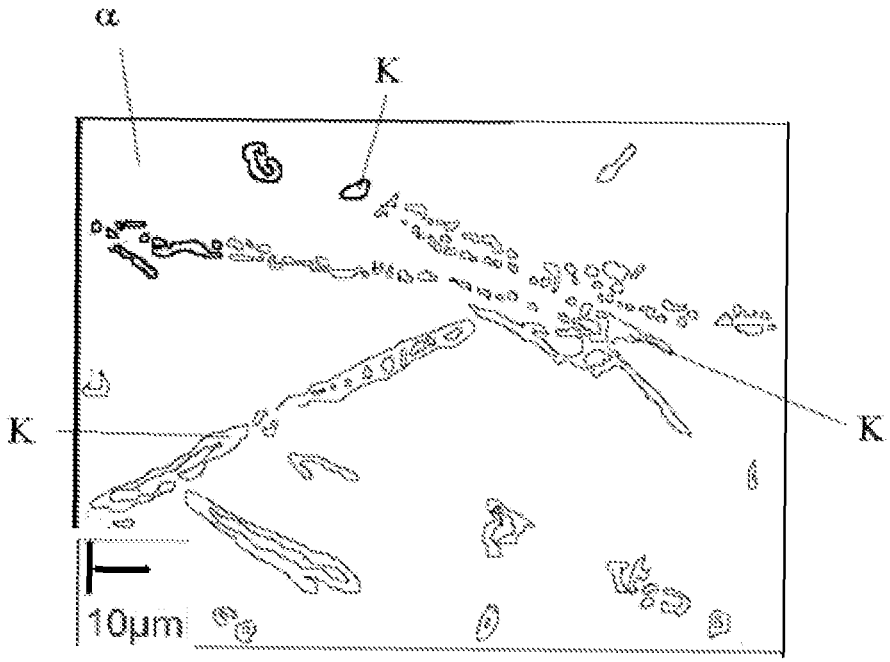
FIG. 2 illustrates the microstructure of a hot-rolled steel sheet that does not satisfy the conditions of the invention.
Figure 4:
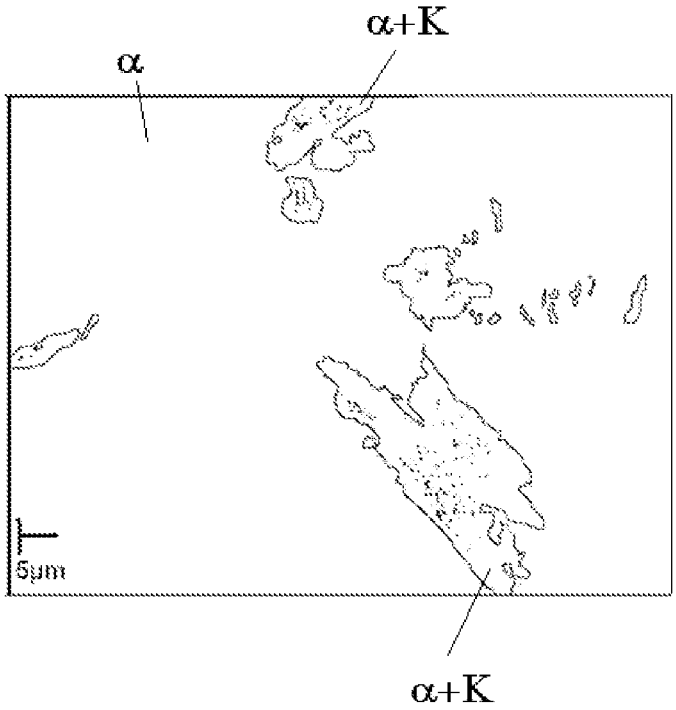
FIG. 4 illustrates the microstructure of a hot-rolled steel sheet that does not satisfy the conditions of the invention.

The sheet is then coiled at a coiling temperature below 600° C., because above that temperature there is a risk that it may not be possible to control the kappa precipitation, and of having more than 5% Kappa precipitation as a result of a significant decomposition of the austenite as illustrated in FIGS. 2 and 4. Preferably, the sheet is coiled at a temperature between 450 and 550° C.

In this stage, a hot-rolled sheet is obtained, and if the objective is a cold-rolled sheet with a thickness less than 5 mm, for example, the following steps are carried out:

Cold rolling with a thickness reduction between 35 and 90%.

The cold-rolled sheet is then heated at a heating rate $V_c$ which is preferably greater than 3° C. to a hold temperature $T_m$ between 800 and 950° C. for a length of time less than 600 seconds to ensure a re-crystallization rate greater than 90% of the strongly work hardened initial structure.

The sheet is then cooled at a rate $V_{ref2}$ to a temperature less than or equal to 500° C., whereby preference is given to a cooling rate greater than 30° C./s to more effectively control the formation of the Kappa precipitates and not to exceed 5% in area content. Below 500° C., an additional heat treatment to facilitate the deposit of a hot dip coating with zinc, for example, will not change the mechanical properties of the sheet claimed by the invention. The inventors have shown that by stopping the cooling at the rate $V_{ref2}$ between 500 and 460° C., to conduct a hold prior to dipping in the zinc bath, the properties specified for the sheet claimed by the invention remain unchanged. The following tests, which are presented as non-restricting examples for purposes of illustration only, will show the advantageous characteristics that can be achieved by the production of steel sheets as claimed by the invention.

Example 1

Hot-Rolled Sheet

Semi-finished products were processed from cast steel. The composition of the semi-finished products, expressed in percent by weight, is presented in table 1 below. The remainder of the composition of the steels illustrated in table 1 consists of iron and the unavoidable impurities resulting from processing.

TABLE 1

Composition of steels (% by weight).

| | C | Mn | Al | Si | Ti | V | Nb | Mn/Al |
|---|---|---|---|---|---|---|---|---|
| I1 | 0.193 | 14.9 | 6.52 | <0.030 | 0.096 | <0.030 | <0.030 | 2.29 |
| I2 | 0.188 | 8.28 | 7.43 | <0.030 | <0.030 | <0.030 | <0.030 | 1.11 |
| R1 | 0.186 | 3.4 | 9.7 | <0.030 | <0.030 | <0.030 | <0.030 | 0.35 |
| R2 | 0.117 | 4.78 | 7.6 | <0.030 | <0.030 | <0.030 | <0.030 | 0.63 |
| R3 | 0.2 | 7.01 | 8.07 | 0.25 | <0.030 | <0.030 | <0.030 | 0.87 |

I = Invention/R = Reference/the underlined values do not conform to the invention.

The products were hot-rolled to obtain hot-rolled sheets and the fabrication conditions are presented in table 2 below with the following abbreviations:

$T_{rech}$: reheat temperature $T_{FL}$: final rolling temperature $V_{ref1}$: cooling temperature after the final rolling pass $T_{bob}$: coiling temperature

TABLE 2

Fabrication conditions of the sheet hot-rolled from the semi-finished products.

| | $T_{rech}$ (° C.) | $T_{FL}$ (° C.) | $V_{ref}1$ | $T_{bob}$ (° C.) |
|---|---|---|---|---|
| I1 | 1180 | 950 | air | 500 |
| I2 | 1230 | 964 | air | 500 |
| R1 | 1300 | 950 | air | 500 |
| R2a | 1230 | 975 | air | 700 |

TABLE 2-continued

Fabrication conditions of the sheet hot-rolled from the semi-finished products.

| | $T_{rech}$ (° C.) | $T_{FL}$ (° C.) | $V_{ref}1$ | $T_{bob}$ (° C.) |
|---|---|---|---|---|
| R2b | 1150 | 954 | water | ambient |
| R3 | 1220 | 927 | 50° C./s | 500 |

I = Invention/R = Reference/the underlined values do not conform to the invention.

Sheets I1 and I2 are sheets, the chemical composition and manufacturing process of which are claimed by the invention. The two chemical compositions are different and have different Mn/Al ratios. The reference sheets R1, R2 and R3 have chemical compositions that do not satisfy the requirements of the invention, in particular in terms of the Mn content, but also the C and Mn content as well as the Mn/Al ratio. R2a and R2b are two tests performed on the same grade R2 in table 1. The hot-rolling was carried out with at least one rolling pass in the presence of ferrite. Cooling in air was at a cooling rate less than 55° C./second.

Table 3 presents the following characteristics:

Ferrite: indicates the presence or absence of recrystallized ferrite with a re-crystallization rate greater than 90% in the microstructure of the sheet after coiling.

Austenite: indicates the presence or absence of austenite in the microstructure of the sheet after coiling.

K: designates the presence of Kappa precipitates in the microstructure with an area fraction of less than 5%. This measurement was made using a scanning electron microscope.

Rm (MPa): the mechanical strength in a tensile test in the longitudinal direction with reference to the rolling direction.

Atot (%): indicates the elongation at fracture in a tensile test in the longitudinal direction with reference to the rolling direction.

Figure 8:
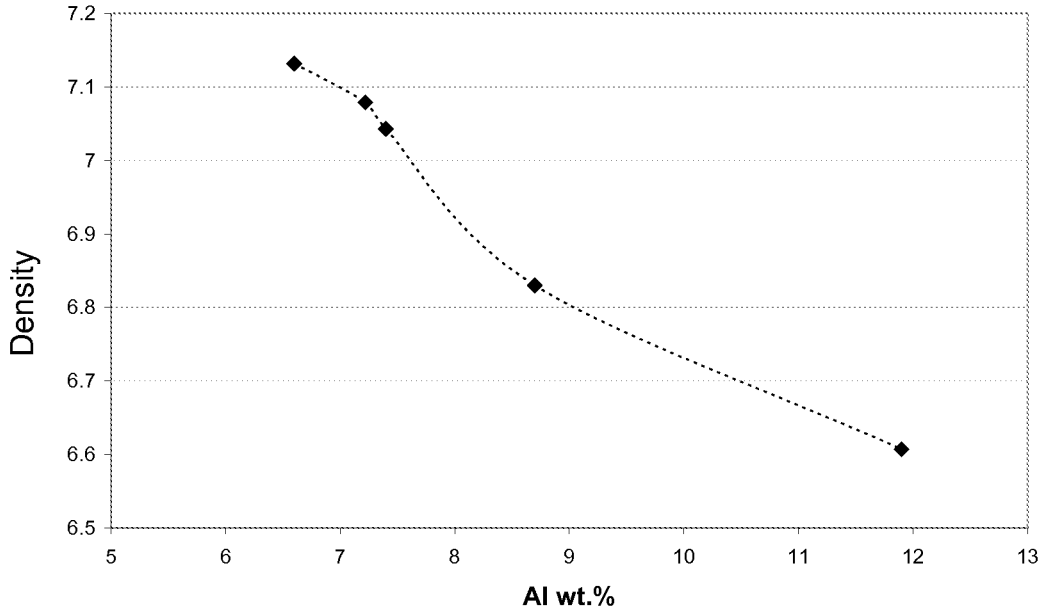
FIG. 8 illustrates the curve of the density as a function of the aluminum content.

Estimated density: on the basis of FIG. 8 depending on the Al content.

Crack: Indicates whether a crack that is clearly visible to the naked eye appeared in the sheet after hot rolling.

X indicates that no measurement was performed.

TABLE 3

Properties of hot-rolled sheet.

| | Ferrite | Austenite | K | Rm (MPa) | Atot (%) | Measured density | Crack |
|---|---|---|---|---|---|---|---|
| I1 | YES | YES | YES | 647 | 41 | <7.3 | NO |
| I2 | YES | YES | YES | 683 | 34.1 | <7.3 | NO |
| R1 | YES | YES | YES | X | X | <7.3 | YES |
| R2a | YES | YES | YES | 560 | 2.9 | <7.3 | NO |
| R2b | YES | YES | YES | 664 | 13 | <7.3 | NO |
| R3 | YES | YES | YES | 810 | 14.1 | <7.3 | YES |

I = Invention/R = Reference/the underlined values do not conform to the invention.

Figure 1:
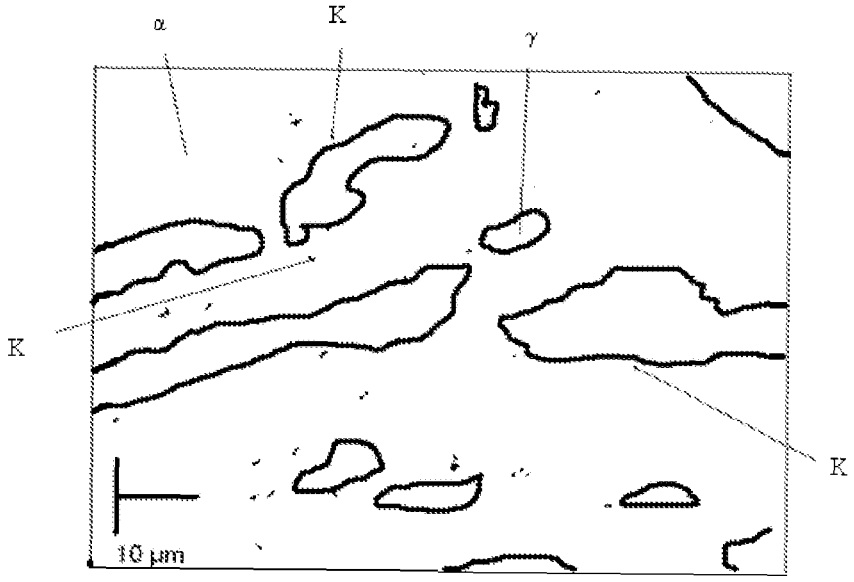
FIG. 1 illustrates the microstructure of a hot-rolled steel sheet according to the present invention.
Figure 6:
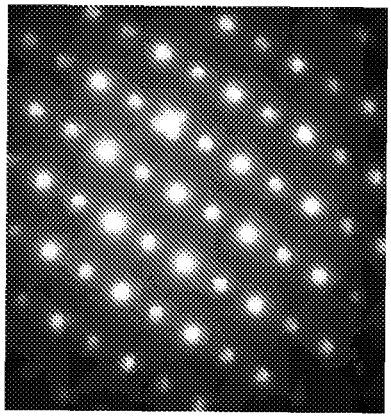
FIG. 6 is an axial diffraction image of zone [110] which makes it possible to identify the Kappa precipitate on a hot-rolled steel sheet according to the present invention.

Steel sheets I1 and I2 are sheets as claimed by the invention. The microstructure of sheet I1 is illustrated in FIG. 1. None of these sheets exhibit cracks after rolling. The mechanical strength is greater than 600 MPa, their elongation at fracture is significantly greater than 20% and they are weldable and coatable. The presence of ferrite and austenite was confirmed using a scanning electron microscope and the presence of Kappa precipitates was confirmed by indexing the diffraction image obtained following observations using a transmission electronic microscope (see FIG. 6).

Sheet R1 has a Mn content of less than 6%, a Mn/Al ratio of less than 1 and a reheat temperature greater than 1280° C. This sheet had cracks after hot rolling. The rollability of this sheet is insufficient. The letter "X" means that there was no tensile test.

Sheets R2a and R2b originated from sheet R2 and have a Mn/Al ratio of less than 1 and a manganese content of less than 6%. R2a was coiled at a temperature greater than 600° C., which led to a decomposition of the austenite into Kappa and ferrite as illustrated in FIG. 4. The elongation did not achieve the required 20%.

Sheet R2B was subjected to rolling conditions as claimed by the invention, but the 20% elongation was not achieved because the chemical composition did not meet the specified conditions, namely that the manganese/aluminum ratio must be less than 1.

Sheet R3 has a Mn/Al ratio of less than 1.0; in spite of the rolling conditions claimed by the invention and alloy elements within the ranges specified by the invention, cracks appeared during hot rolling.

Example 2

Cold-Rolled and Annealed Sheet

Semi-finished products were prepared from a steel casting. The chemical composition of the semi-finished products, expressed in percent by weight, is presented in table 4 below:

The remainder of the composition of the steels presented in table 4 consists of iron and unavoidable impurities resulting from processing.

TABLE 4

Composition of the steel (% by weight).

| | C | Mn | Al | Si | Ti | V | Nb | Mn/Al | Density measured by pycnometry |
|---|---|---|---|---|---|---|---|---|---|
| I3 | 0.21 | 8.2 | 7.4 | 0.26 | <0.030 | <0.030 | <0.030 | 1.11 | 7.04 |
| I4 | 0.21 | 8.6 | 6.1 | 0 | <0.030 | <0.030 | <0.030 | 1.41 | 7.17 |
| I5 | 0.2 | 8.6 | 6.1 | 0.89 | <0.030 | <0.030 | 0.1 | 1.41 | 7.12 |
| I6 | 0.19 | 8.7 | 7.2 | 0 | <0.030 | <0.030 | <0.030 | 1.21 | not measured |

I = invention

The density of I6 was estimated at 7.1 on the basis of the curve in FIG. 8.

The products were first hot-rolled under the conditions indicated below:

TABLE 5

Hot rolling conditions

| | $T_{rech}$ (° C.) | $T_{FL}$ (° C.) | $V_{ref}1$ | $T_{bob}$ (° C.) |
|---|---|---|---|---|
| I3a | 1180 | 905 | 50° C./s | 500 |
| I3b | 1180 | 964 | 50° C./s | 500 |
| I4 | 1150 | 935 | 55° C./s | 450 |
| I5 | 1150 | 952 | 55° C./s | 450 |
| I6 | 1150 | 944 | 50° C./s | 450 |

The sheets were then cold-rolled and annealed. The fabrication conditions are presented in tables 5 and 6 with the following abbreviations:

$T_{rech}$: is the reheat temperature $T_{FL}$: is the final rolling temperature $V_{ref1}$: is the cooling temperature after the final rolling pass.

$T_{bob}$: is the coiling temperature

Rate: is the rate of reduction during the cold rolling $V_c$: is the rate of heating to the hold temperature Tm.

$T_m$: is the recrystallization hold temperature.

$t_m$: is the length of time for which the sheet is held at the temperature $T_m$.

$V_{ref2}$: is the rate of cooling to a temperature below 500° C.

TABLE 6

Fabrication conditions of the cold-rolled and annealed sheet.

| | Rate (%) | $V_c$ (° C./s) | $T_m$ (° C.) | $t_m$ (sec) | $V_{ref2}$ |
|---|---|---|---|---|---|
| I3a | 74 | 15 | 830 | 136 | 50 |
| I3b | 74 | 15 | 850 | 136 | 50 |
| I4 | 75 | 15 | 905 | 136 | 55 |
| I5 | 75 | 15 | 910 | 136 | 55 |
| I6 | 75 | 15 | 909 | 136 | 55 |

I = invention

Sheets I3a, I3b, I4, I5 and I6 are sheets whose chemical composition and fabrication method are those claimed by the invention.

Table 7 presents the following characteristics:

Ferrite: indicates the presence or absence of recrystallized ferrite with a re-crystallization rate greater than 90% in the microstructure of the annealed sheet.

Austenite: indicates the presence or absence of austenite in the microstructure of the sheet after coiling.

K: designates the presence of Kappa precipitates in the microstructure with an area fraction of less than 5%. This measurement was made using a scanning electron microscope. "NO" indicates the absence of kappa precipitates.

Rm (MPa): the mechanical strength in a tensile test in the longitudinal direction with reference to the rolling direction.

Atot (%): indicates the elongation at fracture in a tensile test in the longitudinal direction with reference to the rolling direction.

Measured density: indicates the density measured by pycnometry and illustrated in FIG. 7.

Crack: Indicates whether a crack that is clearly visible to the naked eye appeared in the sheet after rolling.

TABLE 7

Properties of cold-rolled and annealed sheet.

| | Ferrite | Austenite | K | Rm (MPa) | Atot (%) | Measured density | Crack |
|---|---|---|---|---|---|---|---|
| I3a | YES | YES | NO | 831 | 23 | 7.04 | NO |
| I3b | YES | YES | NO | 800 | 26 | 7.04 | NO |
| I4 | YES | YES | NO | 685 | 34 | 7.17 | NO |
| I5 | YES | YES | NO | 742 | 30 | 7.12 | NO |
| I6 | YES | YES | NO | 704 | 22 | 7.1* | NO |

I = invention

*Estimated density of I6.

Figure 5:
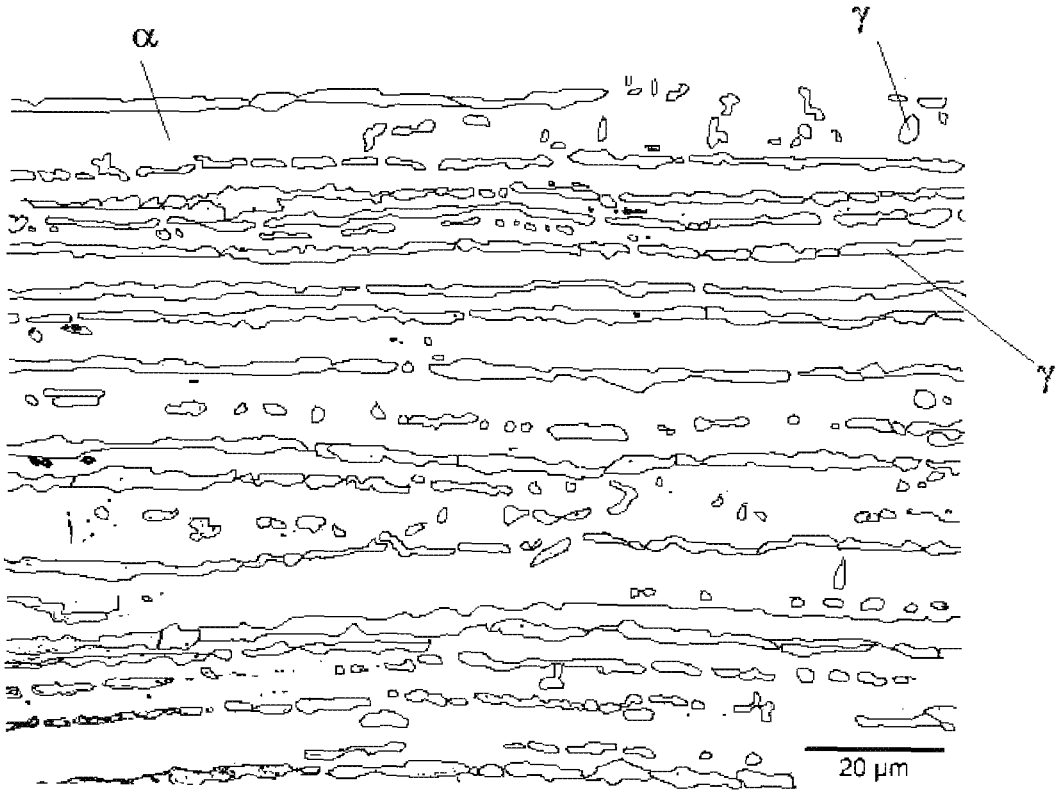
FIG. 5 illustrates the microstructure of a cold-rolled steel sheet according to the present invention.

The cold-rolled steel sheets in table 7 are sheets as claimed by the invention. The microstructure of sheet I3a is illustrated in FIG. 5. None of these sheets exhibited cracks after rolling. The mechanical strength of these sheets is greater than 600 MPa, their elongation at fracture is greater than 20%, they are weldable and sheet I3a was coated with Zn using a hot-dip method called hot-dip galvanization in a Zn bath at 460° C. The sheet, both bare and coated, has good weldability. The steels claimed by the invention also have a good suitability for continuous galvanization in particular.

The steels as claimed by the invention have a good combination of attractive properties for structural parts or skin parts in the automobile industry (low density, good suitability for deformation, good mechanical properties, good weldability and good corrosion resistance with a coating).

What is claimed is:

1. A rolled steel sheet having a relative density of less than or equal to 7.3 and a composition of which comprises the following elements, expressed in percent by weight:

$0.10 \leq C \leq 0.30\%$;

$7.0 \leq Mn \leq 9\%$; and $6.0 \leq Al < 10.0$ a remainder of the composition being composed of iron and the unavoidable impurities caused by processing, wherein Mn/Al >1.0, and a microstructure of the sheet consists of ferrite, austenite and up to 5% Kappa precipitates in area fraction.

2. The steel sheet as recited in claim 1, wherein the composition comprises, expressed in percent by weight: $0.18 \leq C \leq 0.21\%$.

3. The steel sheet as recited in claim 1, the composition of which comprises, expressed in percent by weight: $6.0 \leq Al \leq 9.0\%$.

4. The steel sheet recited in claim 1 further comprising at least one element, expressed as a percentage of weight, selected from:

$Si \leq 2.0\%$;

$Ti \leq 0.2\%$;

$V \leq 0.6\%$; and $Nb \leq 0.3\%$.

5. The steel sheet as recited in claim 4, the composition of which comprises, expressed in percent by weight: $Si \leq 1\%$.

6. The steel sheet as recited in claim 5, wherein the area fraction of Kappa precipitates is less than or equal to 2%.

7. The steel sheet as recited in claim 1, wherein a tensile mechanical strength is greater than or equal to 600 MPa and an elongation at fracture is greater than or equal to 20%.

8. The steel sheet as recited in claim 1, wherein the ratio of the Mn content to the Al content is: $Mn/Al \geq 1.1$.

9. The steel sheet as recited in claim 1, wherein the ratio of the Mn content to the Al content is: $Mn/Al \geq 1.5$.

10. The rolled steel sheet as recited in claim 1, wherein no Kappa precipitates are present.

11. The steel sheet as recited in claim 1, wherein the ferrite is recrystallized ferrite and the microstructure includes at least 90% recrystallized ferrite.

12. The steel sheet as recited in claim 1, wherein the microstructure includes 10% or less of austenite.

13. The steel sheet as recited in claim 1, wherein the microstructure includes more ferrite than austenite.

14. The steel sheet as recited in claim 1, wherein the composition consists of:

$0.10 \leq C \leq 0.30\%$;

$7.0 \leq Mn \leq 9\%$;

$6.0 \leq Al < 10.0$ $Si < 2.0\%$;

$Ti < 0.2\%$ $V < 0.6\%$;

$Nb < 0.3\%$;

$Ce \leq 0.1\%$;

$B \leq 0.01\%$;

$Mg \leq 0.010\%$;

$Zr \leq 0.010\%$; and unavoidable impurities.

15. The steel sheet as recited in claim 1, wherein the microstructure includes at least 90% ferrite.

16. A structural part or skin part for land motor vehicles comprising:

the rolled steel sheet recited in claim 1.

17. A rolled steel sheet having a relative density of less than or equal to 7.3 and a composition of which comprises the following elements, expressed in percent by weight:

$0.10 \leq C \leq 0.30\%$;

$7.0 \leq Mn \leq 8.7\%$; and $6.0 \leq Al < 10.0$ a remainder of the composition being composed of iron and the unavoidable impurities caused by processing, wherein $Mn/Al > 1.0$, and a microstructure of the sheet consists of ferrite, austenite and up to 5% Kappa precipitates in area fraction.

18. A rolled steel sheet having a relative density of less than or equal to 7.3 and a composition of which comprises the following elements, expressed in percent by weight:

$0.10 \leq C \leq 0.30\%$;

$8.2 \leq Mn \leq 8.7$; and $6.0 \leq Al \leq 7.4$ a remainder of the composition being composed of iron and the unavoidable impurities caused by processing, wherein $Mn/Al > 1.0$, and a microstructure of the sheet consists of ferrite, austenite and up to 5% Kappa precipitates in area fraction.

19. A rolled steel sheet having a relative density of less than or equal to 7.3 and a composition of which comprises the following elements, expressed in percent by weight:

$0.10 \leq C \leq 0.30\%$;

$6.0 \leq Mn \leq 15.0\%$; and $6.0 \leq Al < 15.0\%$, a remainder of the composition being composed of iron and the unavoidable impurities caused by processing, wherein $Mn/Al > 1.0$, and a microstructure of the sheet consists of ferrite, austenite and Kappa precipitates, the Kappa precipitates being up to 5% in area fraction, the ferrite being at least 90% in area fraction.

20. The steel sheet as recited in claim 19, wherein the composition comprises, expressed in percent by weight: $7.0 \leq Mn \leq 8.7\%$.

21. The steel sheet as recited in claim 19, wherein the composition comprises, expressed in percent by weight: $0.18 \leq C \leq 0.21\%$.

22. The steel sheet as recited in claim 19, the composition of which comprises, expressed in percent by weight: $6.0 \leq Al \leq 12.0\%$.

23. The steel sheet as recited in claim 19, the composition of which comprises, expressed in percent by weight: $6.0 \leq Al \leq 9.0\%$.

24. The steel sheet recited in claim 19 further comprising at least one element, expressed as a percentage of weight, selected from:

$Si \leq 2.0\%$;

$Ti \leq 0.2\%$;

$V \leq 0.6\%$; and $Nb \leq 0.3\%$.

25. The steel sheet as recited in claim 24, the composition of which comprises, expressed in percent by weight: $Si \leq 1\%$.

26. The steel sheet as recited in claim 19, wherein the area fraction of Kappa precipitates is less than or equal to 2%.

27. The steel sheet as recited in claim 19, wherein a tensile mechanical strength is greater than or equal to 600 MPa and an elongation at fracture is greater than or equal to 20%.

28. The steel sheet as recited in claim 19, wherein the ratio of the Mn content to the Al content is: $Mn/Al \geq 1.1$.

29. The steel sheet as recited in claim 19, wherein the ratio of the Mn content to the Al content is: $Mn/Al \geq 1.5$.

30. The steel sheet as recited in claim 19, wherein the ratio of the Mn content to the Al content of is: $Mn/Al \geq 2.0$.

31. A structural part or skin part for land motor vehicles comprising:

the rolled steel sheet recited in claim 19.

32. A rolled steel sheet having a relative density of less than or equal to 7.3 and a composition of which comprises the following elements, expressed in percent by weight:

$0.10 \leq C \leq 0.30\%$;

$8.2 \leq Mn \leq 8.7\%$; and $6.0 \leq Al \leq 7.4$, a remainder of the composition being composed of iron and the unavoidable impurities caused by processing, wherein $Mn/Al > 1.0$, and a microstructure of the sheet consists of ferrite, austenite and Kappa precipitates, the Kappa precipitates being up to 5% in area fraction.

* * * * *